US006009879A

United States Patent [19]

Vuilleumier et al.

[11] Patent Number: 6,009,879

[45] Date of Patent: Jan. 4, 2000

[54] TOBACCO TRIMMING AND PRE-EQUALIZING DEVICE

[75] Inventors: David Vuilleumier, Colombier; Jean-Jacques Beguin, Cernier, both of Switzerland

[73] Assignee: Philip Morris Incorporated, New York, N.Y.

[21] Appl. No.: 08/927,991

[22] Filed: Sep. 12, 1997

[51] Int. Cl.[7] ..... A24C 5/18

[52] U.S. Cl. ..... 131/84.2; 131/84.1; 131/84.3; 131/84.4

[58] Field of Search ..... 131/38, 84.1, 84.2, 131/84.3, 84.4

[56] References Cited

U.S. PATENT DOCUMENTS

| | | | |
|---|---|---|---|
| 4,306,573 | 12/1981 | Rudszinat | 131/84.4 |
| 4,485,826 | 12/1984 | Holzangel . | |
| 4,697,603 | 10/1987 | Steinhauer et al. | 131/84.4 |
| 4,703,764 | 11/1987 | Marquardt et al. | 131/84.4 |
| 5,003,996 | 4/1991 | Tallier et al. | 131/84.4 |
| 5,168,882 | 12/1992 | Beguin et al. | 131/84.4 |
| 5,526,826 | 6/1996 | Heitmann . | |
| 5,769,096 | 6/1998 | Okumoto | 131/84.4 |

FOREIGN PATENT DOCUMENTS

| | | | |
|---|---|---|---|
| 0465414 | 1/1992 | European Pat. Off. . | |
| 0645098 | 3/1995 | European Pat. Off. . | |
| 2103513 | 8/1972 | Germany . | |
| 2440980 | 3/1976 | Germany . | |
| 4202198 | 7/1993 | Germany . | |
| 924445 | 4/1963 | United Kingdom | 131/84.4 |
| 2052242 | 1/1981 | United Kingdom | 131/84.4 |

OTHER PUBLICATIONS 97 12 1148 Search Report.

*Primary Examiner*—Stanley S. Silverman
*Assistant Examiner*—Michael P. Colaianni
*Attorney, Agent, or Firm*—Charles E. B. Glenn; Kevin B. Osborne; Clinton H. Hallman, Jr.

[57] ABSTRACT

An apparatus for forming a tobacco rod for cigarette manufacture, fitted with a suction-type rod conveyor equipped with a revolving, continuous, porous belt, to which vacuum is applied from the top and on whose underside tobacco shreds are conveyed along a tobacco channel. The apparatus has a pre-equalizer for purposes of equalizing the height of the tobacco rod being conveyed by removing a part of the tobacco rod. The apparatus further has a device that serves to compact the tobacco rod at regular intervals and further has an equalizer that equalizes the height of the tobacco rod after it that is compacted at regular intervals by removing additional tobacco from the tobacco rod. The pre-equalizer has a revolving blade which is positioned directly below the tobacco channel.

12 Claims, 10 Drawing Sheets

TOBACCO TRIMMING AND PRE-EQUALIZING DEVICE

BACKGROUND OF THE INVENTION

A. Technical Field of the Invention

The invention relates to a suction device for the formation of a tobacco rod for use in cigarette manufacture. Such a device is equipped with a suction-type rod conveyor which employs an air-permeable belt to transport tobacco shreds along a tobacco channel.

Such equipment may also have a pre-equalizer which equalizes the height of the tobacco rod being conveyed by removing part of the tobacco rod. It also may be provided with a device that compacts the tobacco rod at regular intervals and an equalizer which uniformly sets the height of the tobacco rod to a pre-specified height by removing additional tobacco from the tobacco rod.

B. Description of the Related Art

The device is part of a cigarette rod-making machine. In cigarette rod-making machines, tobacco shreds in the form of a shower of loose tobacco are aspirated by negative pressure from below onto the continuous, air-permeable belt of a suction-type rod conveyor. The formed tobacco rod is placed onto strips of wrapping material and wrapped in them. The continuous tobacco rod thus created is then cut into individual cigarettes. In order to obtain a uniform tobacco density inside the cigarettes, it is necessary to form a cigarette rod on the suction-type rod conveyor and the height of the rod must be as uniform as possible. In order to prevent the tobacco shreds from spilling out, cigarettes have a somewhat higher tobacco density at their tip. For this reason, at regular intervals, the tobacco rod being formed on the rod conveyor is compacted, for instance, by means of a rotating cam.

Pre-equalization of the height of the tobacco rod takes place prior to compacting, while the final equalization of the tobacco rod is carried out after compacting. For purposes of pre-equalization, it is a generally known to employ paddle wheels which are positioned diagonally to the direction of the tobacco rod and which remove protruding tobacco from the rod surface, pushing it to the side (EP-A 0,645,098); a cylindrical, rotating disk whose rotational plane is perpendicular to the direction of the height irregularities of the tobacco rod is also known (EP-A 0,465,414). The latter pre-equalizer makes it possible to remove excess tobacco from the tobacco rod in a relatively gentle manner, so that it can then be returned to the production process without a detrimental effect on the quality.

Difficulties arise in connection with the use of tobacco mixtures which have a high proportion of Oriental tobacco since such tobacco mixtures have considerably more ribs than are found, for example, in American tobacco blends; moreover, problems are also encountered when tobacco mixtures having very long shreds are used, as is increasingly the case due to improved tobacco preparation techniques and also when tobacco shreds having a larger cut width are used, for instance, up to the 3.5 mm typically found in smoking products instead of the commonly employed cut width of, for example, 0.85 mm. With such tobacco mixtures, there is a risk that additional tobacco shreds will be pulled out of the tobacco rod, so that, following the pre-equalization procedure, there will be a hole or a thin spot in the tobacco rod at a site that was previously occupied by tobacco.

For purposes of the final equalization, devices are known which have two overlapping circular blades (EP-A 0,137, 604). One of these circular blades can also have a serrated edge (U.S. Pat No. 3,413,979 and GB-C 1,024,941). The equalizer can be fitted with two retaining disks touching each other along their circumference, between which any protruding tobacco shreds are clamped, after which the protruding tobacco shreds are cut off by means of a scraper, a rotating blade, a tubular cutter (DE-A 4,202,198) or a paddle wheel (DE-A 3,407,893). The tubular cutter employed according to DE-A 4,202,198 consists of a leading edge formed by the triangular or rectangular teeth of a rotating, tubular element. The axis of the tubular element faces the direction of the tobacco rod and it is inclined downwards. The cutting edge of the tubular cutter that is active at any given moment is positioned perpendicular to the tobacco rod. These equalizers are very complex and call for a precise alignment of the individual components. They require a relatively large space. For these reasons, they have not yet been used as pre-equalizers.

II. OBJECTS OF THE INVENTION

The invention has the object of creating a device capable of forming a tobacco rod for cigarette manufacture by means of which it is also possible to produce cigarettes having a uniform packing density in conjunction with increased packing density at their tip, even in the case of cigarettes made of tobacco mixtures containing particularly long tobacco shreds with a larger cut width or with a high proportion of Oriental tobacco.

III. SUMMARY OF THE INVENTION

The present invention contemplates supplying a pre-equalizer which has a revolving blade situated immediately below the tobacco channel.

Several embodiments of the invention will be illustrated below with reference to the drawings.

IV. BRIEF DESCRIPTION OF THE DRAWINGS

V. DETAILED DESCRIPTION

Figure 1:
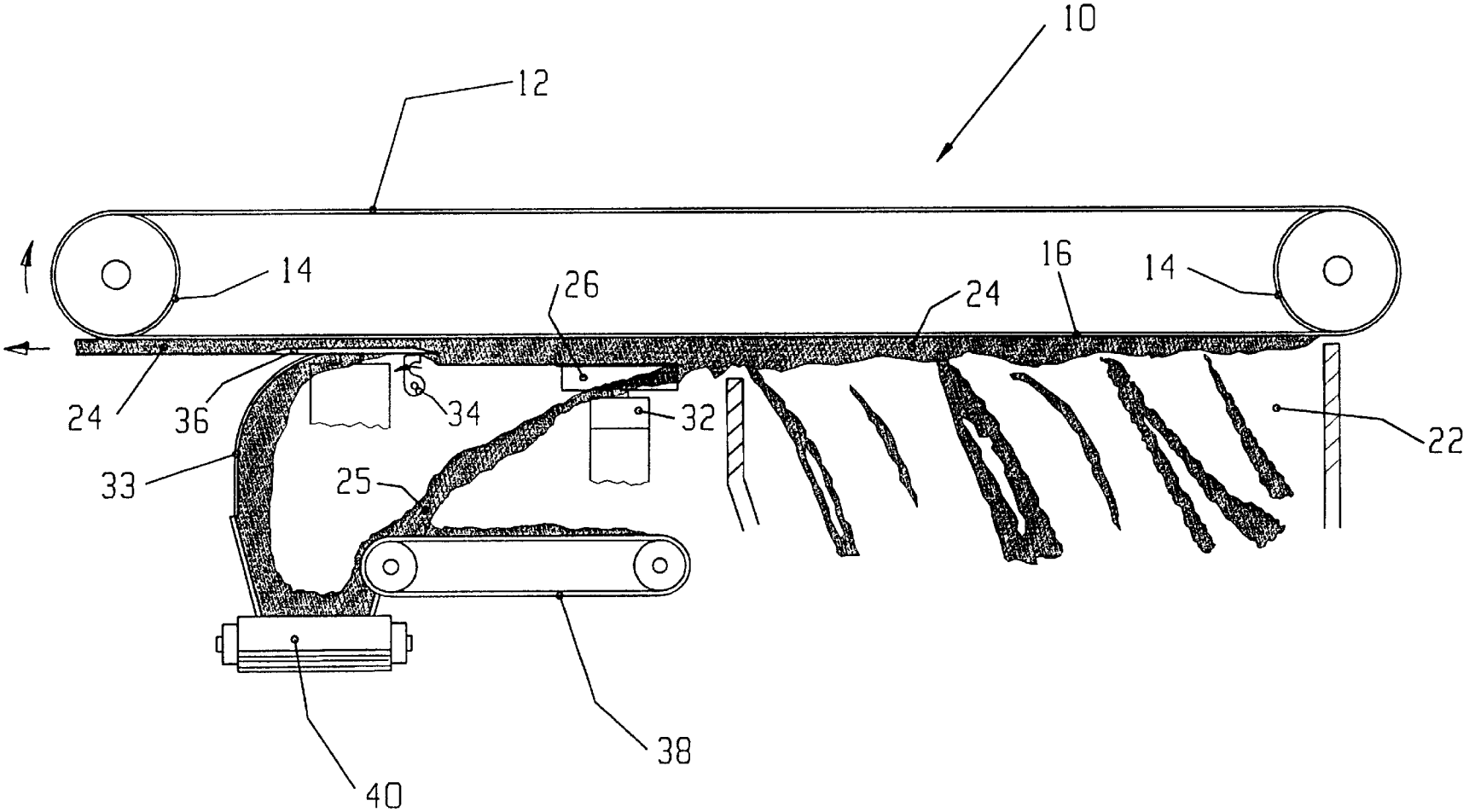
FIG. 1 is a lateral view of a suction-type rod conveyor, including tobacco rod height control devices.

The invention of the present application describes a pre-equalizer which has a revolving blade situated immediately below the tobacco channel.

Preferably, this revolving blade is a rotating circular blade which is arranged in such a way that its edge overlaps with the tobacco channel. The edge of the overlapping area of the circular blade facing opposite to the conveying direction moves in the direction of movement of the tobacco rod and is inclined at an angle of about 30 to 50 degrees with respect to the tobacco rod, preferably at about 45 degrees. As a result of this positioning of the cutting area of the circular blade at an angle to the tobacco rod, the protruding tobacco shreds are precisely and neatly trimmed, especially also when a preferred circular blade with a smoothly polished edge is employed.

The revolving blade can also preferably be designed as a tubular cutter whereby the axis of the tubular cutter is somewhat slanted downwards in the direction of movement of the tobacco rod so that only the cutting edge comes into contact with the tobacco shreds, thereby forming an angle of 40 to 60 degrees with respect to the longitudinal direction of the tobacco rod when seen from above, preferably 50 degrees.

The configuration of the cutting edge at an angle to the tobacco rod prevents the blade from causing tobacco shreds to accumulate in places in the tobacco channel. If the cuffing edge of the circular blade or of the tubular cutter is undulated, then the cuffing edge can also be positioned perpendicular, that is to say, at an angle of about or less than 90 degrees with respect to the longitudinal direction of the tobacco rod.

Preferably, the cutting edge of the revolving blade moves at a speed of approximately 5 m/s relative to the tobacco rod. This corresponds to a speed that is about 30% higher than the commonly employed speed of the tobacco rod of, for example, 560 m/min.

The circular blade has a diameter of, for instance, 90 mm and, in the case of a speed of the tobacco rod of 560 m/min in the area that overlaps with the tobacco channel, it can move at a speed of around 850 m/min. This blade cuts off ribs and longer shreds, thereby eliminating the risk that tobacco shreds extending from deeper layers of the tobacco rod might be pulled out together with the long shreds or with the tobacco ribs to which they are attached.

Preferably, the circular blade is tilted downwards at an angle of up to 30 degrees with respect to the direction of movement of the tobacco rod, so that the front section of the circular blade is at a greater distance from the underside of the tobacco rod. Such a tilted configuration of the circular blade imparts the excess tobacco removed from the tobacco rod by means of the pre-equalizer with an additional downward movement component, thus assisting the removal of the tobacco away from the aspiration zone of the suction-type rod conveyor.

Preferably, the circular blade is secured on a rotation-symmetrical or cylindrical element having a diameter that is somewhat smaller than that of the circular blade. Such a rotation-symmetrical or cylindrical element imparts the tobacco shreds which are severed from the tobacco rod by means of the circular blade with a momentum that takes them away from the aspiration zone of the suction-type rod conveyor.

This momentum can be improved by arranging axially running grooves on the circumference of the rotation-symmetrical element, whereby the circumferential area of the element can taper downwards in a conical shape. The half conical angle that is, the angle beta between the conical surface and the axial direction is greater than the angle alpha by which the circular blade is tilted. Thus, the trailing edge of the rotating element always points slightly in the direction of movement of the tobacco rod, as a result of which the trimmed tobacco shreds acquire a forward movement component.

The pre-equalizer can also be fitted with two overlapping circular blades which trim the protruding tobacco shreds.

The device according to the invention used to form a tobacco rod for cigarette manufacture can also be a double rod-making machine. In that case, there is at least one revolving blade for each tobacco rod.

The apparatus may be best understood by reference to the accompanying figures, which are meant by way of explanation and not limitation.

FIG. 1 shows a lateral view of a device to form a tobacco rod 24 for cigarette manufacture. The device has a suction-type rod conveyor 10 equipped with a continuous, porous belt 12, for example, a perforated belt or an air-permeable fabric belt which is continuous and which is wrapped around two deflection rollers 14. The belt 12 runs clockwise, as seen in FIG. 1. With its lateral guide rails 18 in FIG. 2, the lower run 16 of the belt 12 forms a tobacco channel 20 that is open towards the bottom.

The beginning of tobacco channel 20 lies above a tobacco shaft 22 through which tobacco shreds are aspirated against the underside of the lower run 16 by means of a vacuum that is applied to the lower run 16. In the tobacco channel 20, the aspirated shreds form a tobacco rod 24 which initially has a very irregular surface and an uneven distribution of the tobacco.

Figure 2:
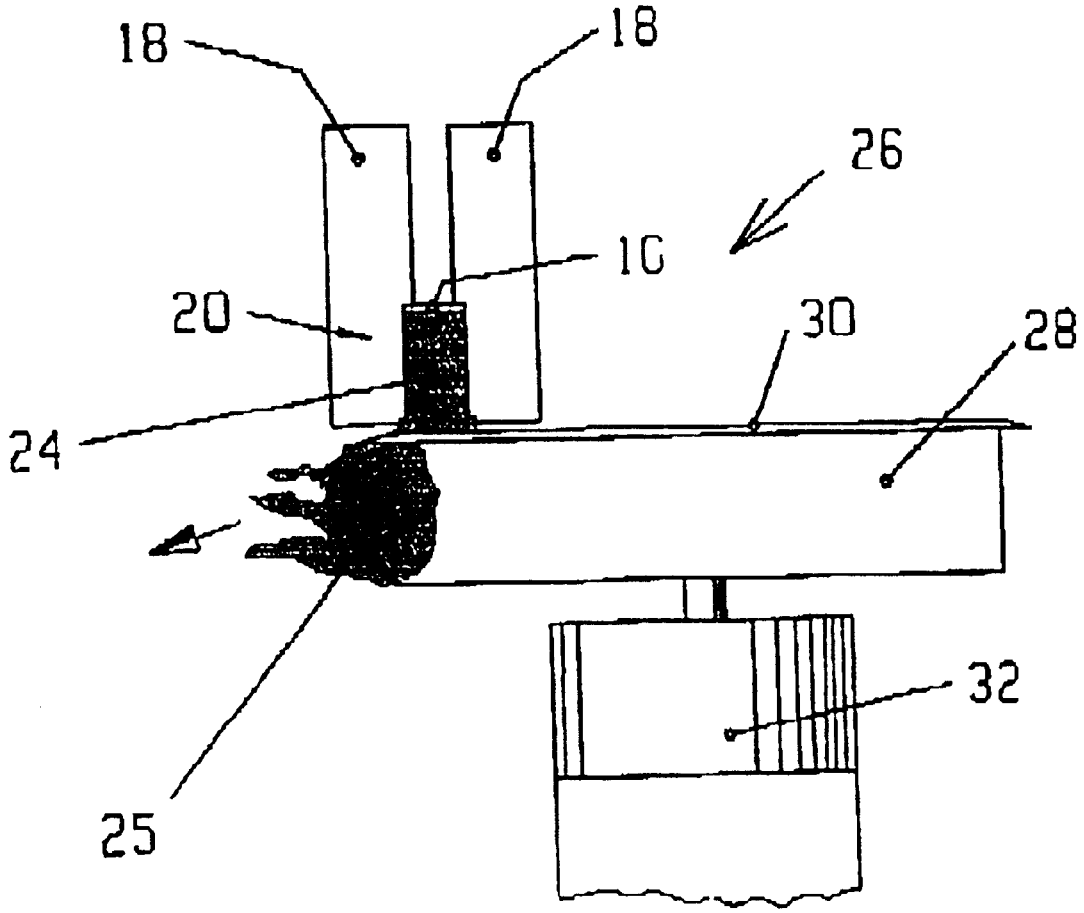
FIG. 2 is a view of the pre-equalizer illustrated in FIG. 1 viewed along the tobacco rod line.

A pre-equalizer 26 is employed to equalize the height of the tobacco rod 24. This pre-equalizer 26 is positioned in the direction of movement of the tobacco rod 24 after the tobacco shaft 22 and it has a cylindrical element 28 fitted with a protruding circular blade 30 which extends somewhat beyond the edge of the cylindrical element 28. This cylindrical element 28 and the circular blade 30 are rotated around their central axes by means of a drive motor 32. The circular blade 30 is arranged at a small distance below the lateral guide rails 18 of the tobacco channel 20 and laterally staggered in such a way that an edge area of circular blade 30 covers the tobacco channel 20 from below. Likewise, the cylindrical element 28 overlaps the entire width of the tobacco channel 20, as shown in FIG. 2.

As a result of the laterally staggered arrangement of the circular blade 30, the edge area of the circular blade 30 that overlaps the tobacco channel 20 has a cutting edge 35 facing opposite to the direction of movement of the tobacco rod 24 running at an angle to the longitudinal direction of the tobacco rod 24. In the embodiment shown, the angle between the cutting edge 35 and the longitudinal direction of the tobacco rod 24 is somewhat less than 45 degrees. Therefore, the tobacco 25 protruding downwards under the lateral guide rails 18 is at first severed by the circular blade 30 from the part of the tobacco rod 24 that is completely inside the tobacco channel 20 and subsequently pushed aside by the lateral wall of the cylindrical element 28, so that it is no longer exposed to the negative pressure that prevails inside the tobacco channel 20 and therefore cannot be sucked against the belt once again.

In this context, the lower run 16 of the belt 12 moves at a speed of, for example, 560 m/min and this is the speed at which the tobacco rod 24 is further conveyed. At the site of their overlapping with the tobacco channel 20, the circular blade 30 and the cylindrical element 28 have a speed that is approximately 30% higher, namely, 850 m/min.

Figure 3:
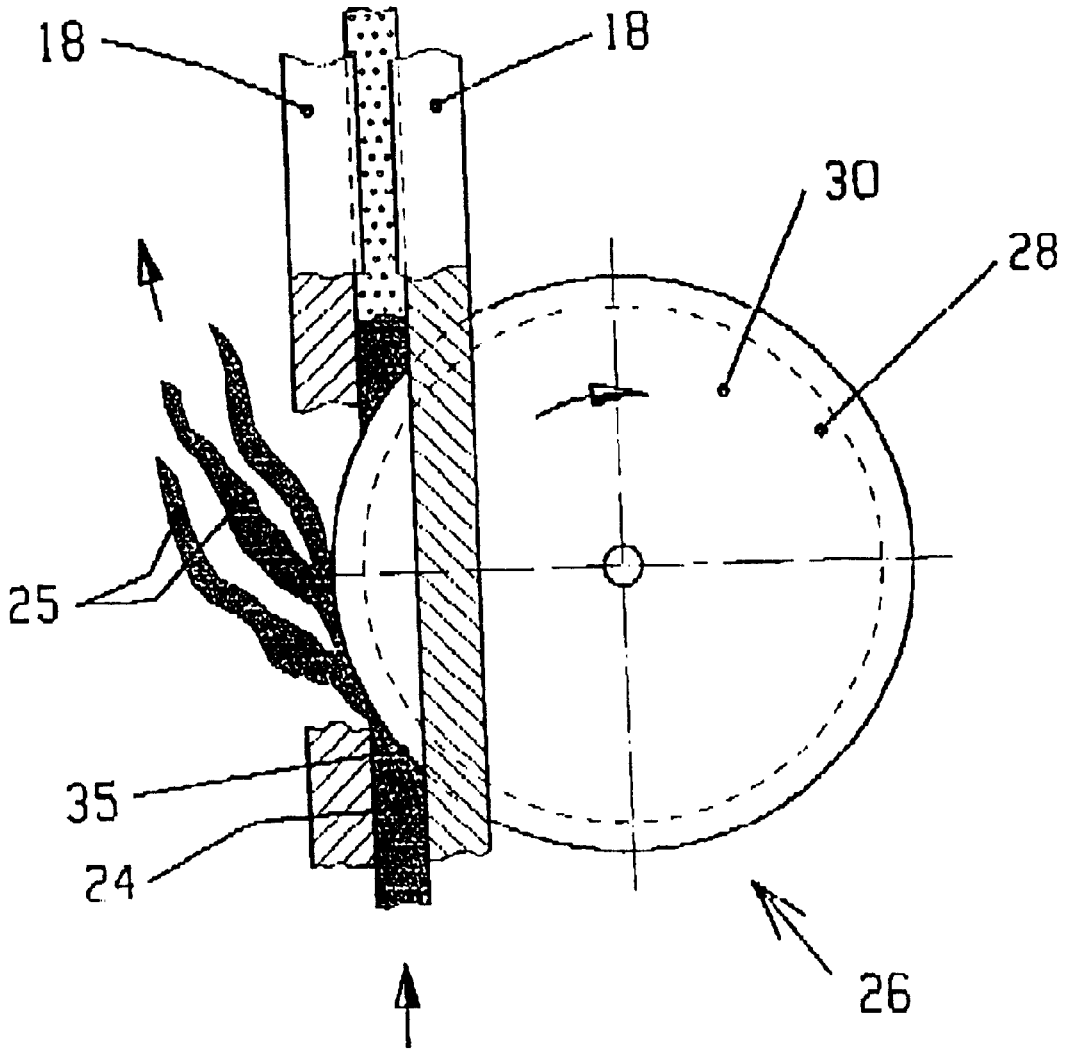
FIG. 3 is a view of the pre-equalizer illustrated in FIG. 1 from above.

As indicated in FIG. 3, at the site of their overlapping with the tobacco channel 20, the cylindrical element 28 and the circular blade 30 move in the same direction as the lower run 16. As a result of the contact with the circular blade 30 and possibly with the outside of the cylindrical element 28, the trimmed tobacco shreds 25 are then pushed laterally towards the front.

As can be further seen in FIG. 1, downstream from the pre-equalizer 26, there is a compacting device in the form of a cam blade 34 which rotates around an axis positioned horizontally perpendicular to the run 16 and which dips into tobacco channel 20 once with each rotation, where it compacts the tobacco at regular intervals. These compacted sites later make up the cigarette tips and this compacting is aimed at preventing the tobacco shreds at the cigarette tips from coming loose. The compacting device can also be designed as described in U.S. Pat. No. 5,501,233 and be in the form of a star wheel, whereby certain radial elements have short support surfaces on the circumferential direction which compact the tobacco rod 24 at certain sites.

Directly after the cam blade 34, there is an equalizer 36 which equalizes the tobacco rod 24, including the compacted sites, to a prescribed height. Since the compacting device equipped with the cam blade 24 and the equalizer 36 can be of any familiar type, they will not be elaborated upon here.

Preferably, the equalizer is designed as described in FIG. 2 of EP-A 0,137,604, with two overlapping circular blades which serve to trim the tobacco shreds. In the case of the embodiment depicted in FIG. 1, the equalizer 36 has two overlapping circular blades which sever protruding tobacco shreds. A scraper 33 lies against the circular blade from below. This scraper 33 collects the trimmed tobacco shreds and guides them downwards, so that they cannot be sucked against the belt again by the suction-type rod conveyor 12. For this purpose, the scraper 33 is preferably made of spring steel sheet so as to only exert a minimum of pressure against the circular blade of the equalizer 36.

The tobacco 25 that is removed from the tobacco rod 24 by the pre-equalizer 26 and by the equalizer 36 is collected by the conveyor belts 38, 40 and returned to the tobacco supply. The tobacco rod 24 is subsequently wrapped with cigarette paper in a known manner and processed into cigarettes.

Figure 4:
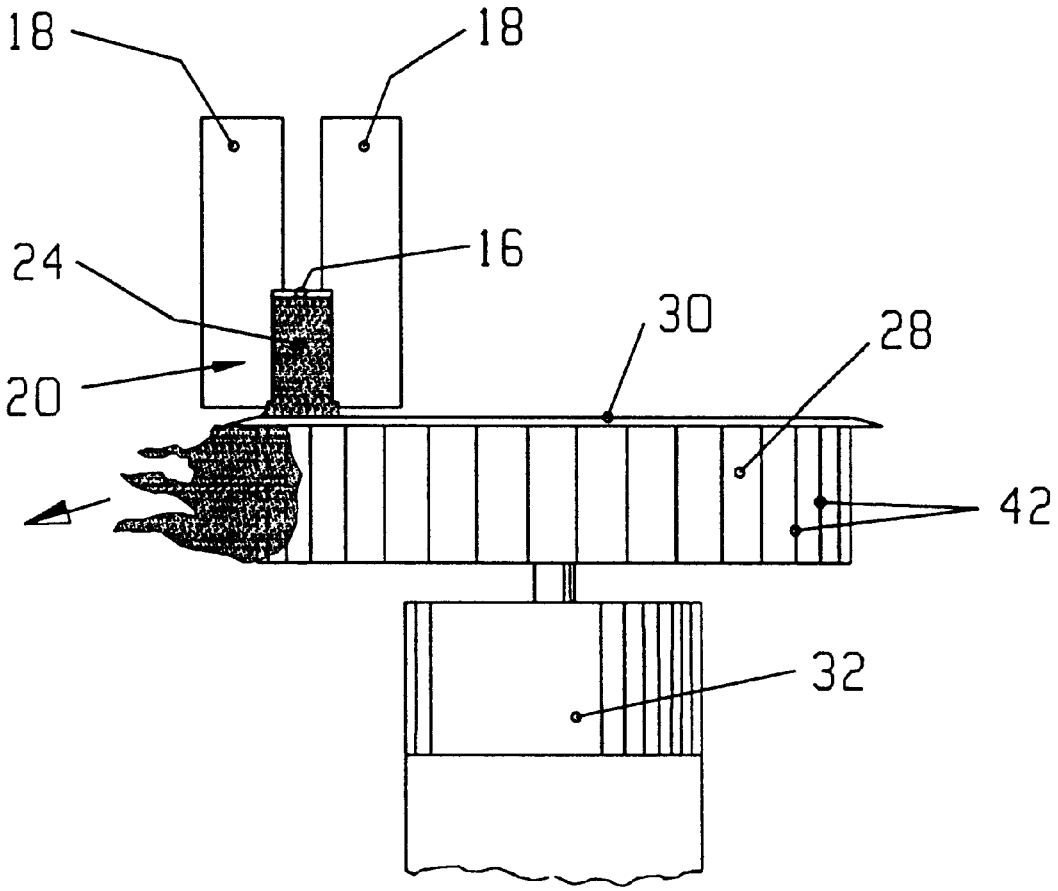
FIG. 4 is a side view of another embodiment of the pre-equalizer.
Figure 5:
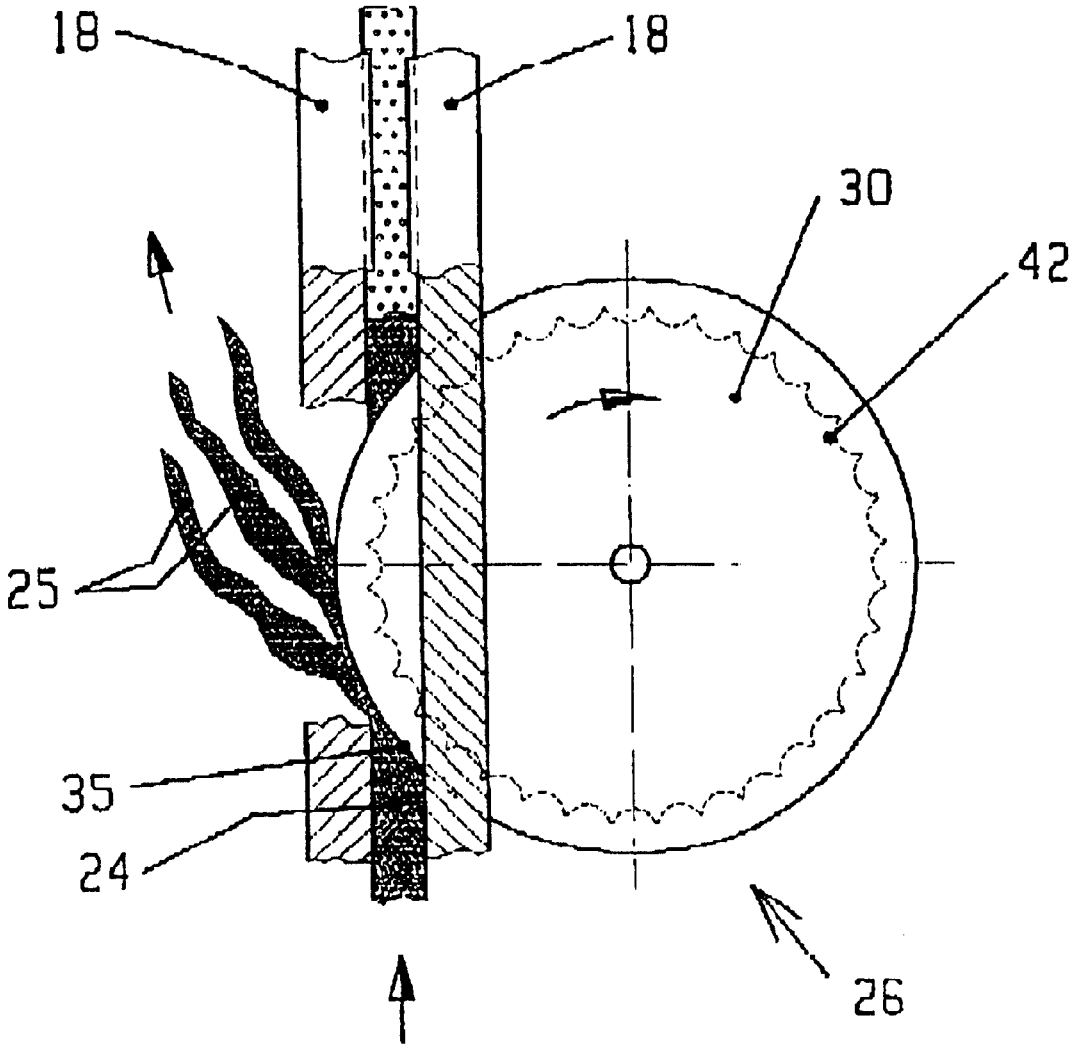
FIG. 5 is a view from above of another embodiment of the pre-equalizer.

As shown in FIGS. 4 and 5, the exterior of the cylindrical element 28 can have grooves 42 which are even more effective for pushing the trimmed tobacco shreds 25 to the side and forward.

Figure 6:
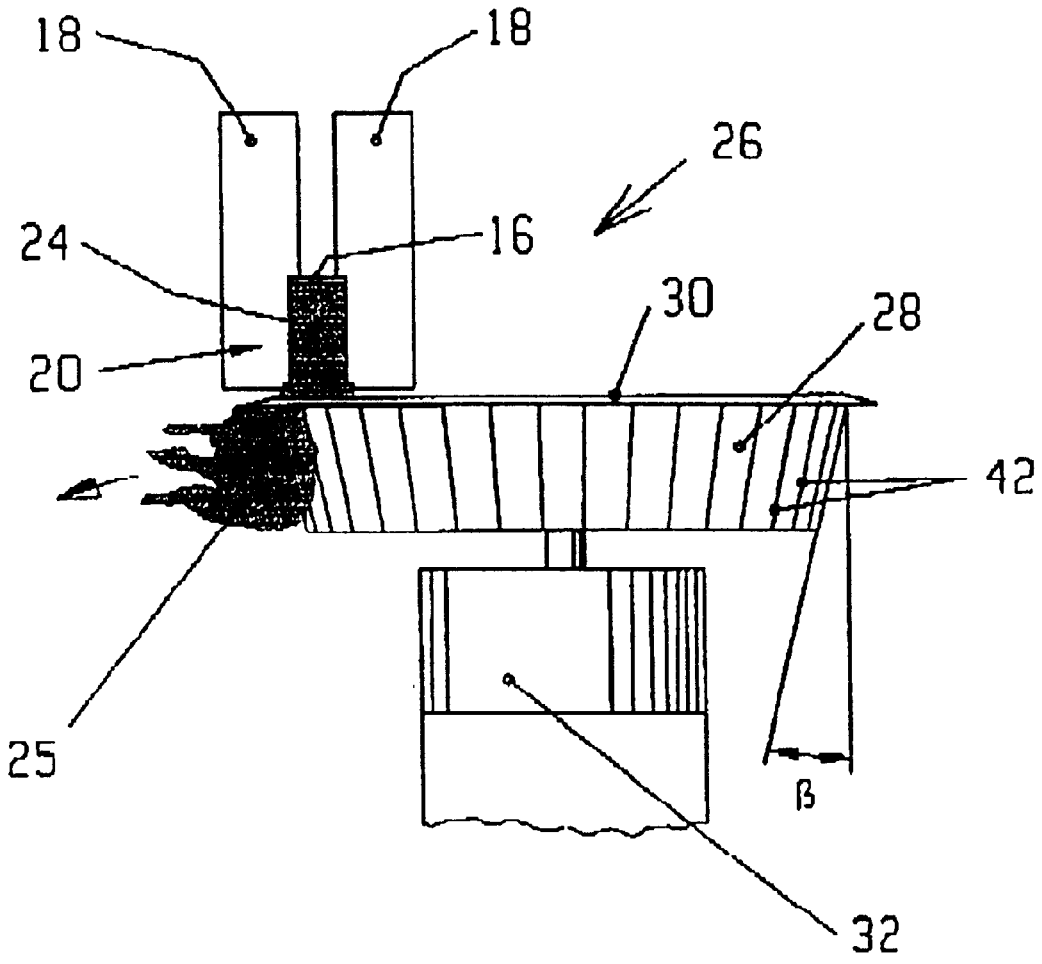
FIG. 6 is a side view of a third embodiment of the pre-equalizer.

As shown in FIG. 6, the lateral wall of the cylindrical element 28 can taper downwards so that the trimmed tobacco shreds are concurrently imparted with a downward movement component.

Figure 7:
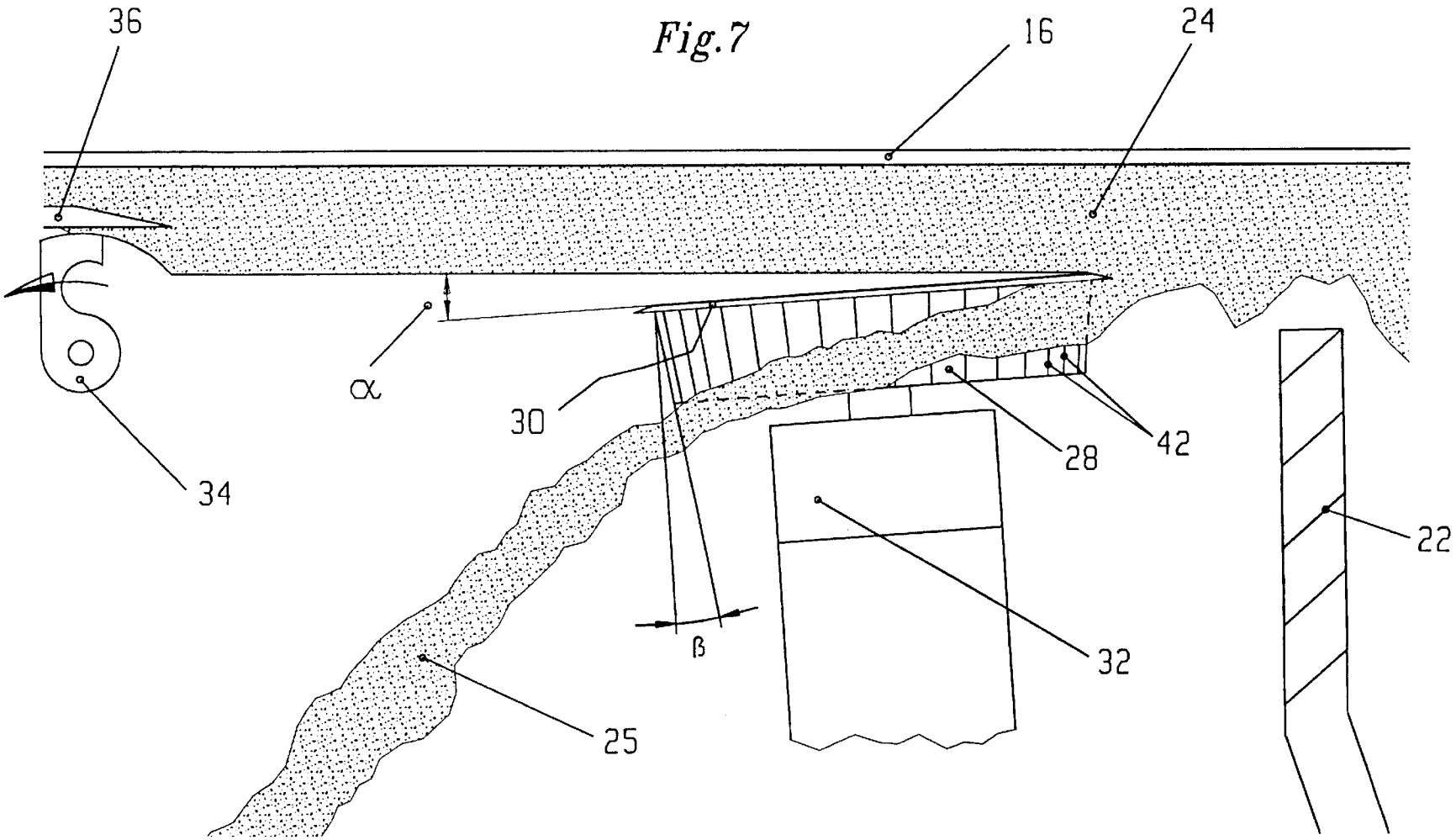
FIG. 7 is a side view rotated at 90 degrees from the view of FIG. 6 of the pre-equalizer.

FIG. 7 depicts an especially preferred embodiment of the invention in which the rotational axis of the cylindrical element 28 and of the circular blade 30 is slanted forward by an angle. As a result, only the rear face of the cutting edge of the circular blade 30 comes into contact with the tobacco rod 24 and it moves away from the tobacco rod 24 as it continues its motion, thereby eliminating a risk that tobacco shreds adhering to the surface of the circular blade 30 might be pushed aside or laterally pressed into the tobacco channel 20.

At the same time, this imparts the trimmed tobacco shreds with a movement component directed slightly downwards. The angle preferably lies within the range from 0 degrees to 30 degrees, most preferably about 15 degrees, although it can also be greater in individual cases. In this context, the angle of inclination is smaller than the flank angle, so that the rear edge is somewhat facing forward. This prevents some of the trimmed tobacco shreds 25 from moving towards the back and reaching the suction zone of the tobacco shaft 22.

Figure 8:
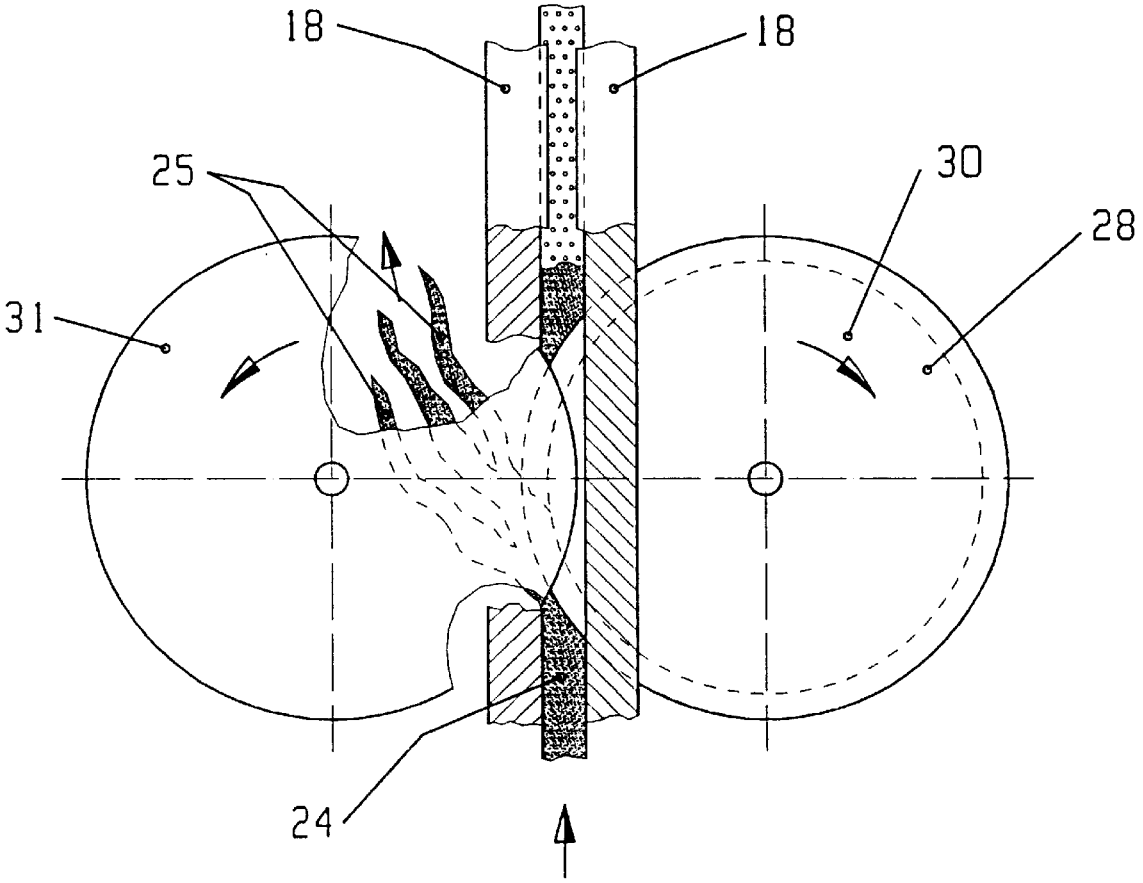
FIG. 8 is a top view of an embodiment of a pre-equalizer with two circular blades.

FIG. 8 shows a top view of a pre-equalizer equipped with two circular blades 30, 31, the edge of each of which only overlaps part of the tobacco channel 20. The circular blades 30, 31 themselves overlap inside the tobacco channel 20, so that they trim the protruding tobacco shreds 25. With this embodiment, cylindrical elements 28 can be positioned under one or both circular blades 30, 31. However, proper functioning can also be obtained without cylindrical elements.

Figure 9:
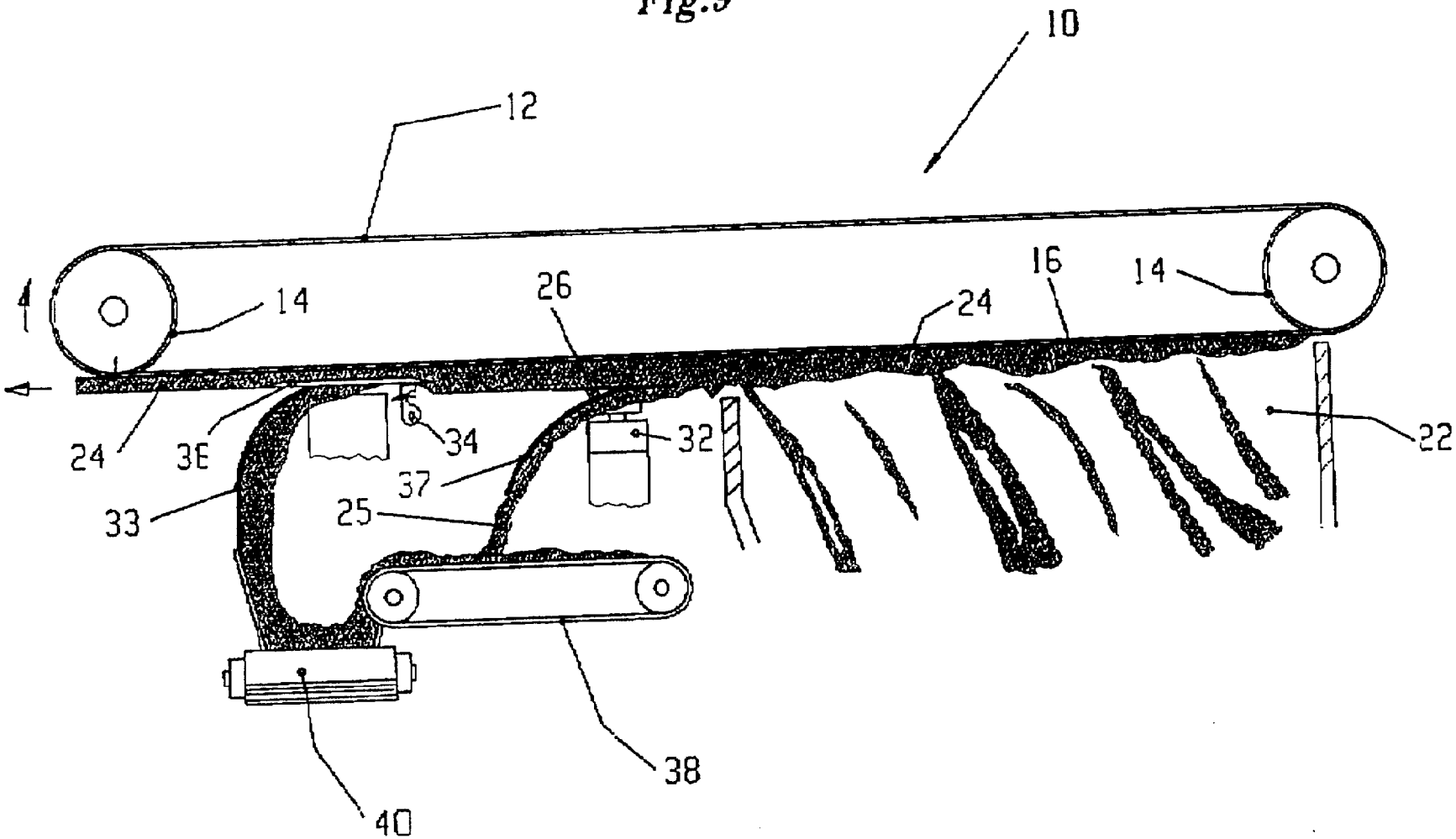
FIG. 9 is a side view of a pre-equalizer with a circular blade and a scraper.
Figure 10:
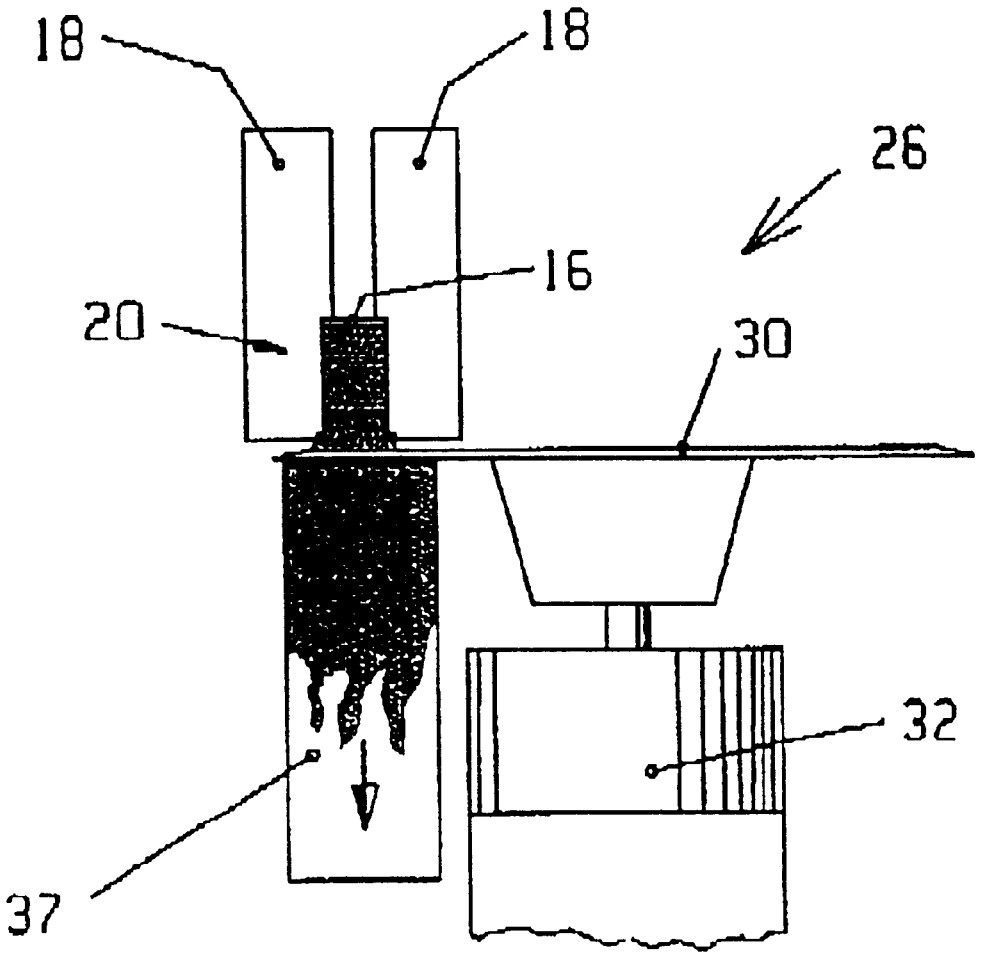
FIG. 10 is a view of the pre-equalizer of FIG. 9 in a sectional view along the tobacco rod.

With the embodiment according to FIGS. 9 and 10, the pre-equalizer 26 has a circular blade 30. Under the circular blade 30, there is a scraper 37 which catches the trimmed tobacco shreds and guides them downwards from the aspiration zone of the suction-type rod conveyor 10 and onto the conveyor belt 38. Here, the scraper 37 replaces the cylindrical element 28. It can be used as a matter of principle instead of the cylindrical element 28. The scraper 37 is preferably made of spring steel sheet so as to only exert a minimum of pressure against the circular blade 30 from below.

This circular blade 30 and, if applicable, the additional circular blade 31, can be made of simple 0.25 mm-thick steel sheet and can have a smoothly polished edge on one or both sides. The circular blades 30, 31 can also be made of hard metal with a thickness ranging from 0.3 mm to 0.35 mm and likewise have a smoothly polished edge on one or both sides. If only one circular blade 30 is employed, it can also be undulated in shape.

Having described the invention as above, we claim:

1. An apparatus for forming a tobacco rod for cigarette manufacture, comprising a tobacco channel formed from a suction conveyor and a pair of guide rails for directing a flow of tobacco shreds;

a pre-equalizer comprising a revolving blade positioned substantially directly below said tobacco channel, and a rotationally symmetrical element below said revolving blade and attached to said blade, the rotationally symmetrical element having an outwardly facing surface and rotating with the revolving blade and having at least one axially running groove on said outwardly facing surface;

a compactor for periodically compacting said tobacco shreds downstream from said pre-equalizer; and an equalizer downstream from said compactor for evening out the tobacco rod.

2. An apparatus according to claim 1, wherein the blade is a circular blade placed such that its edge overlaps the tobacco channel when viewed from above.

3. An apparatus according to claim 1, wherein the circular blade has an outer periphery overlapping the tobacco channel, and said periphery is capable of traveling at an angular velocity such that the periphery moves faster than the belt.

4. An apparatus according to claim 3, wherein the outer periphery that overlaps the tobacco channel is capable of traveling at least 30% faster than the belt.

5. An apparatus according to claim 3, wherein the outer periphery that overlaps the tobacco channel is capable of traveling at least 5 m/min faster than the belt.

6. An apparatus according to claim 1, wherein the rotation-symmetrical element has an annular outer surface which tapers in a conical shape.

7. An apparatus according to claim 2, wherein a scraper is located below the circular blade, and directs trimmed tobacco shreds from the aspiration zone of the suction-type rod conveyor and downwardly.

8. An apparatus according to claim 2, wherein the rotational axis of the circular blade is tilted forward by an angle of up to 30 degrees, whereby only the rear face of the cutting edge of the circular blade touches the tobacco rod.

9. An apparatus according to claim 8, wherein a conically tapered rotation symmetrical element is located below the circular blade and the angle of inclination of the rotational axis of the circular blade is smaller than the flank angle of the conical tapering of the rotation symmetrical element.

10. An apparatus according to claim 2, wherein the pre-equalizer has two circular blades which overlap inside the tobacco channel, whereby the tobacco shreds are trimmed.

11. An apparatus according to claim 1, wherein the rear face of the cutting edge of the circular blade located inside the tobacco channel forms an angle of about 30 to 50 degrees with the longitudinal direction of the tobacco channel.

12. An apparatus according to claim 1, wherein the blade has an undulating or serrated cutting edge.

* * * * *